US005421177A

United States Patent [19]

Sieber et al.

[11] Patent Number: 5,421,177

[45] Date of Patent: Jun. 6, 1995

[54] SECURITY TAG, WHICH CAN BE FITTED TO AN OBJECT, FOR SIGNALLING AN ATTEMPTED THEFT

[75] Inventors: Heinrich Sieber, Marbach; Roland Wolf, Schoenenberg, both of Switzerland

[73] Assignee: Venda Security Systems, Inc., Flagler Beach, Fla.

[21] Appl. No.: 861,364

[22] Filed: Mar. 30, 1992

[30] Foreign Application Priority Data

Dec. 16, 1991 [CH] Switzerland ..... 03740/91

[51] Int. Cl.[6] ..... E05B 65/00

[52] U.S. Cl. ..... 70/57.1; 292/307 R; 292/320; 340/572; 24/704.1

[58] Field of Search ..... 70/57, 58, 57.1, 14, 70/19, 20, 31, 35, 38; 292/307 R, 316, 319–321; 24/303, 704.1; 340/572

[56] References Cited

U.S. PATENT DOCUMENTS

| | | | |
|---|---|---|---|
| 63,467 | 4/1867 | Bush | 70/38 C |
| 645,874 | 3/1900 | Smith | 70/20 |
| 3,702,637 | 11/1972 | Bower | 292/307 R X |
| 3,947,930 | 4/1976 | Martens et al. | 70/57.1 |
| 4,299,417 | 11/1981 | McClure | 292/320 |
| 4,299,870 | 11/1981 | Humble | 70/57.1 X |
| 4,311,992 | 1/1982 | De Chant | 70/57.1 X |
| 4,483,049 | 11/1984 | Gustavsson et al. . | |
| 4,649,397 | 3/1987 | Heaton et al. | 70/57.1 X |
| 4,651,136 | 3/1987 | Anderson et al. | 70/57.1 X |
| 4,993,245 | 2/1991 | Ott | 70/57.1 |
| 5,118,148 | 6/1992 | DeLima Castro Netto | 292/320 X |

FOREIGN PATENT DOCUMENTS

| | | | |
|---|---|---|---|
| 385540 | 9/1990 | European Pat. Off. | 70/57.1 |
| 405155 | 1/1991 | European Pat. Off. . | |
| 2306137 | 10/1976 | France | 292/320 |
| 2639743 | 6/1990 | France | 70/57.1 |
| 499805 | 11/1928 | Germany | 70/38 C |

*Primary Examiner*—Peter M. Cuomo
*Assistant Examiner*—Suzanne L. Dino
*Attorney, Agent, or Firm*—Oblon, Spivak, McClelland, Maier & Neustadt

[57] ABSTRACT

The security tag (10) has a housing (11) and a clasp (12), which can move longitudinally therein, in the manner of a padlock. In its closed position, a piston (20), which is prestressed by a spring (21), engages into a gap or interruption (15) in the clasp (12). In order to open the clasp (12), a reduced-pressure source, which raises the piston (20), is placed onto a projection (28), so that the said piston releases the clasp (12). The use of a reduced-pressure source exacerbates the unauthorized opening of the security tag.

26 Claims, 4 Drawing Sheets

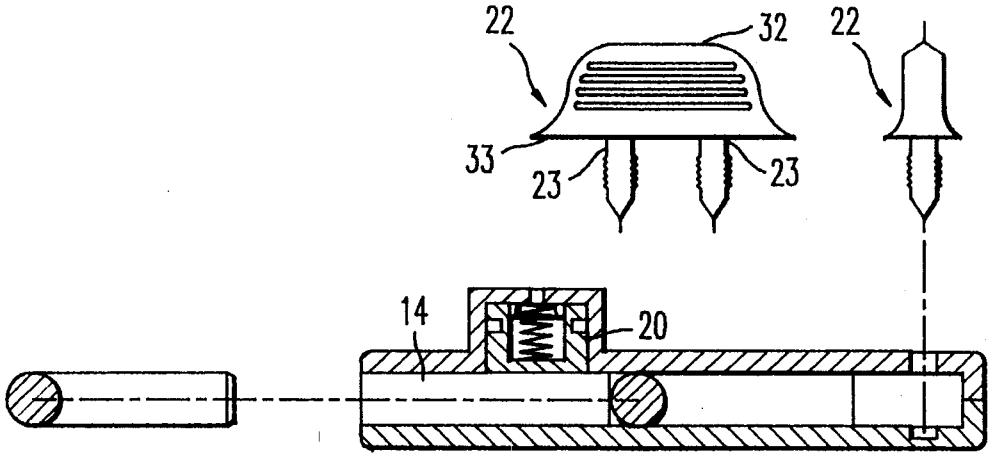
FIG. 6
FIG. 7
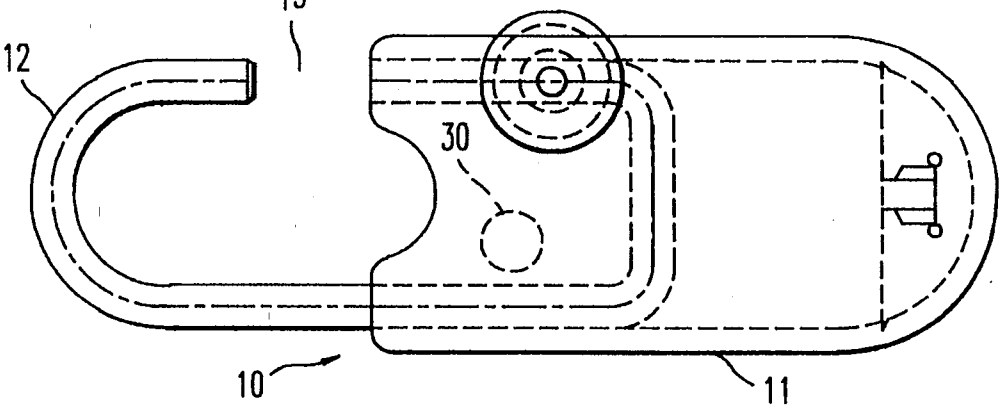
FIG. 5
FIG. 4

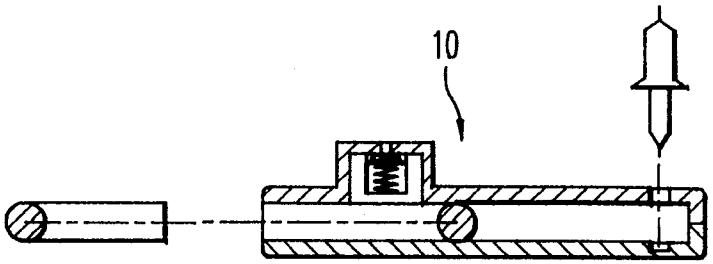
FIG. 9B
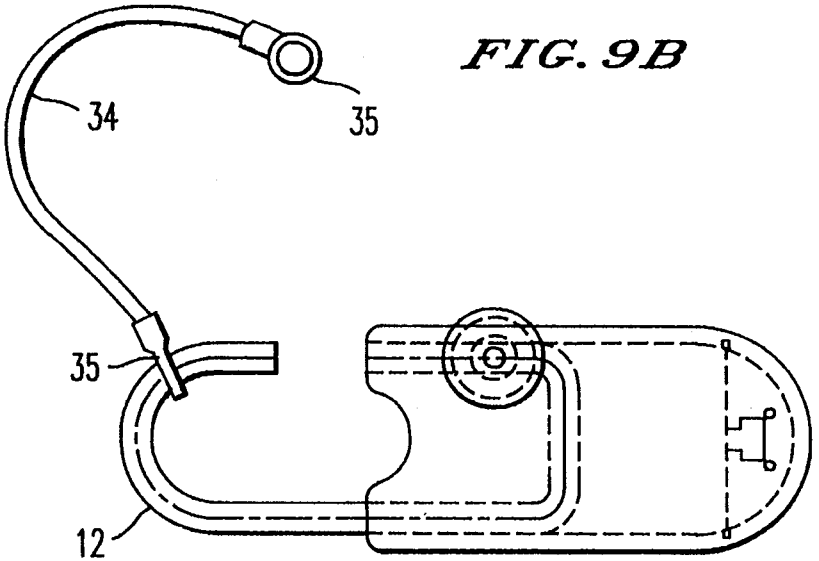
FIG. 9A
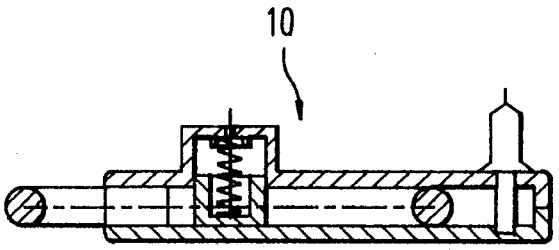
FIG. 8B
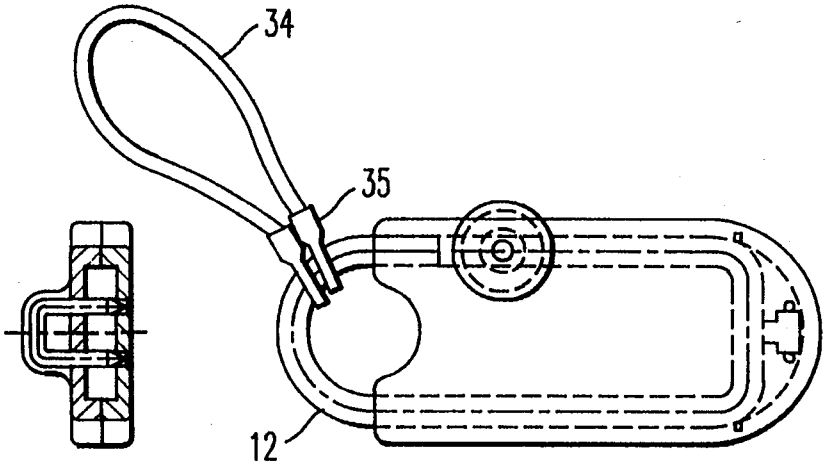
FIG. 8C
FIG. 8A

FIG. 10
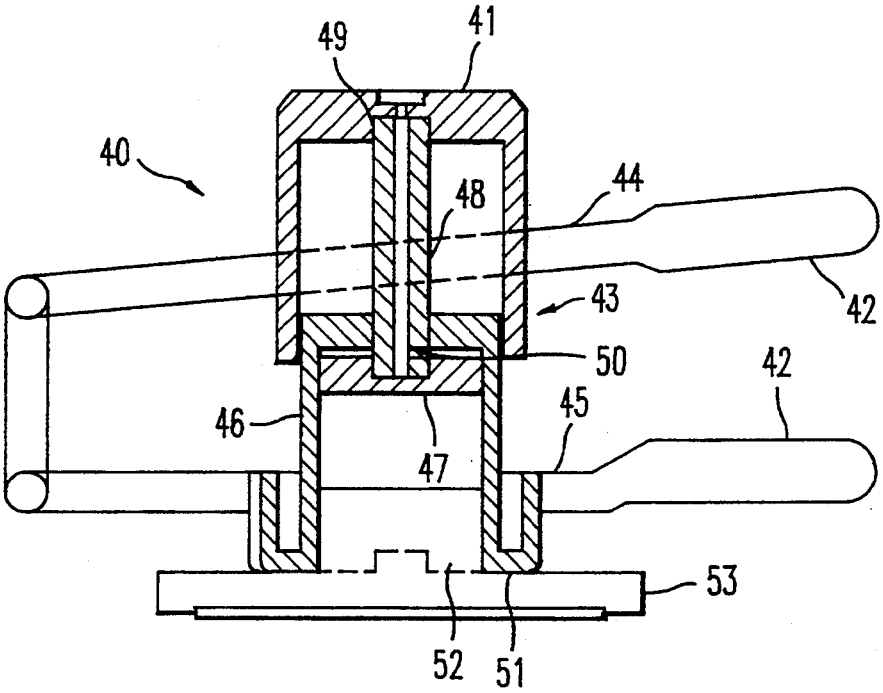
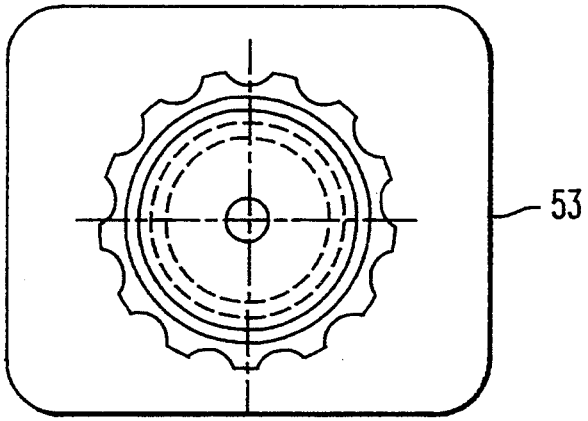
FIG. 11

SECURITY TAG, WHICH CAN BE FITTED TO AN OBJECT, FOR SIGNALLING AN ATTEMPTED THEFT

BACKGROUND OF THE INVENTION

1. Field of the Invention

The invention relates to a security tag and to an unlocking device for releasing the fastening parts of the security tag.

2. Discussion of the Background

Security tags which trigger an audible signal, are known for example when leaving shop premises, if the object which is protected thereby is taken through a barrier which operates without contact. Such a barrier can, for example, have an induction loop with an oscillator and the security tag can have an inductor which causes a resonance. Such means for triggering a signal are, however, not the subject of the present invention and are assumed to be known, so that the said means are not described in detail here.

A security tag of the type mentioned initially, disclosed in EP-Al 0,405,155, can be opened on a mechanical or magnetic basis. Although special devices are provided for opening, it is not inconceivable that such security tags can be opened even without such devices by way of other means, for example magnets, and the goods protected thereby can be stolen.

SUMMARY OF THE INVENTION

The invention is thus based on the object of providing a security tag and an unlocking device interacting therewith which exacerbate opening by other means or even render it impossible.

This object presented is achieved according to the invention as disclosed herein.

The solution according to the invention assumes the availability of a pressure or reduced-pressure source. Such a device is, however, far more difficult to carry on the person than means for the mechanical or magnetic opening of the security tag. In addition, the security tag can be designed in such a manner that it is not immediately apparent what means will allow it to be opened.

A particularly preferred embodiment requires a reduced-pressure source for opening, whose procurement is considerably more difficult than that of a pressure source, for example a bicycle pump. Such an embodiment therefore ensures even better protection against unauthorised opening.

An embodiment or aspect represents a special, substantial design which also ensures special protection against violent opening.

According to a further aspect, it can be identified that the clasp moves only in the longitudinal direction but, in contrast to a generally known padlock, cannot be pivoted. In consequence, the design gains even more in stability.

In accordance with a further aspect, a security tag arrangement is provided which causes the clasp to spring up after being released by the unlocking element and hence simplifies handling.

Claim 6 shows a preferred and particularly simple embodiment for the spring intended for opening.

An alternate embodiment provides a different possibility for attaching the security tag to the object to be protected. This is especially advantageous when the object has no loops or eyes. However, it is also possible to combine this feature with one of the other embodiments or features.

A further preferred embodiment or aspect ensures a particularly secure retention of the security plug by positive-locking instead of force-locking, as in the case of the prior art provided by the said EP-A1 0,405,155.

According to a further aspect of the invention, a more substantial type of attachment of the security tag to the object to be protected results from duplicating the pins.

As a result of an additional aspect according to the present invention matching to different fabric thicknesses can be achieved if the security tag is used for protecting products consisting of fabric.

A further object and aspect of the invention simplifies the placement of an unlocking device onto the security tag or vice versa.

According to a further aspect, a cable is provided as an extension of the clasp is provided, in order that larger objects can also be provided with the security tag in the event that suspension with the clasp is not possible. The cable can also be used for connection to a stationary signalling device which triggers a warning signal on removal of the cable.

According to a still further aspect an unlocking device is also provided which interacts with the security tag.

In accordance with another object of the present invention, an unlocking device is provided which requires no energy connection for electricity or compressed air to operate the unlocking device.

According to a further aspect, the unlocking device can be operated as a portable tool in a similar manner to pliers. It is thus not linked to a location and can be used, for example, on clothing racks.

In accordance with a preferred embodiment an arrangement is associated with the unlocking device for generating a reduced pressure, to the extent that the security tag is designed for unlocking by means of a reduced pressure.

According to a further object and advantageous aspect, the unlocking device can be converted without any effort from a portable device into a stationary device, for example for use at a checkout.

Exemplary embodiments of the invention are explained in more detail using the drawings, in which:

BRIEF DESCRIPTION OF THE DRAWINGS

FIG. 4 shows the security tag according to FIG. 1 in the opened position, FIG. 5 shows a central longitudinal section according to FIG. 4, FIG. 6 shows a security plug, seen on its broad side, FIG. 7 shows the security plug according to FIG. 6, seen on its narrow side, FIGS. 8A–C respectively show end, side and plan views of the security tag in a closed position with an additional extension cord, FIGS. 9A and B show the security tag according to FIG. 8, but in the opened position, FIG. 10 shows an unlocking device in longitudinal section and FIG. 11 shows a base of the unlocking device according to FIG. 10, in plan view.

DESCRIPTION OF THE PREFERRED EMBODIMENTS

Figure 2:
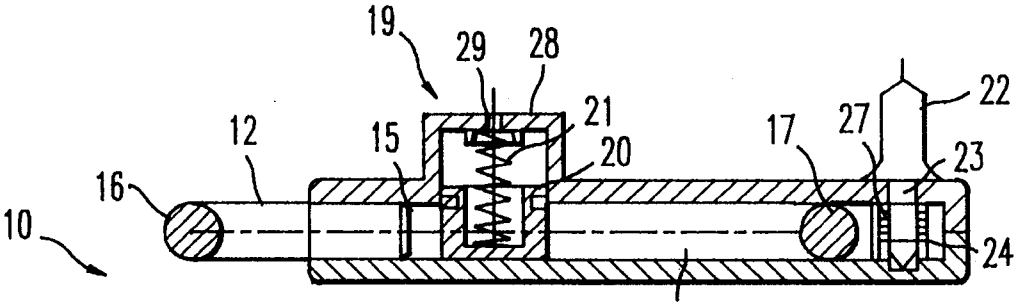
FIG. 2 shows a central longitudinal section according to FIG. 1.
Figure 1:
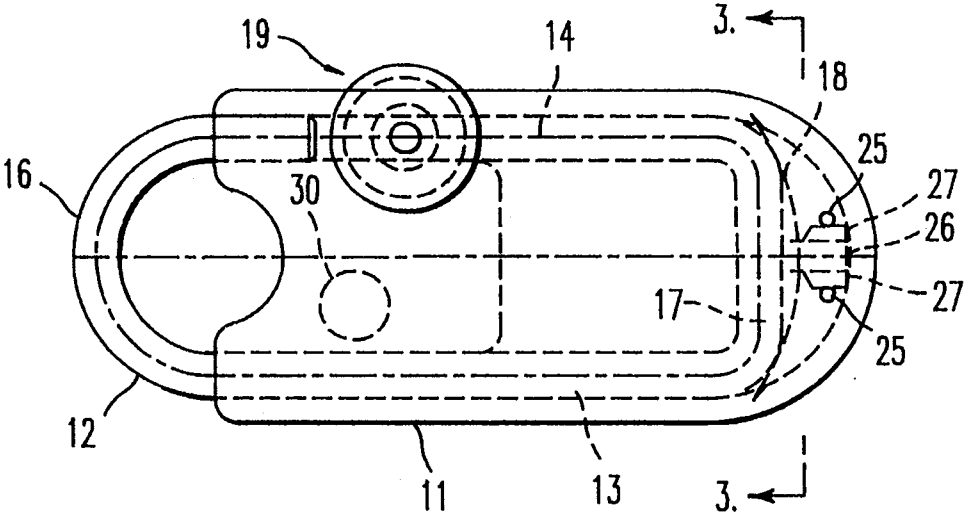
FIG. 1 shows a closed security tag in plan view.

The security tag 10, shown in FIGS. 1 and 2, has a housing 11 and a clasp 12, supported such that it can move longitudinally therein. The clasp 12 at least approximately has the shape of a zero with elongated limbs 13, 14, one 14 of which has a gap or interruption 15. The outer end 16 of the clasp 12 projects out of the housing 11. In the closed position, a leafspring 18, which generates prestressing in the opening direction, rests on the inner end 17 of the clasp 12.

A locking device 19 has a piston 20, acting as a locking element. Said piston engages under the influence of a helical spring 21, supported in a fixed position, into the gap 15 of the clasp 12, in order to lock the latter in its closed position.

A security plug 22, which is bent into a U-shape and whose pins 23 forming the limbs have lateral grooves 24, is inserted in the connection on the inner end 17 of the clasp 12. In order to lock the security plug 22 in its closed position, held in holes 25 in the housing 11, the locking device 19 furthermore includes a second locking element 26 which has projections 27 on its two sides, by means of which it engages into the lateral grooves 24 of the pins 23 of the security plug 22. This results in the security plug 22 being locked in a positively locking manner.

The second locking element 26 is designed on the leafspring 18 and, with the clasp closed, is pushed between the two pins 23 of the security plug 22. As part of the leafspring 18, the locking element 26 has a bent tongue with lugs, the edges of the lugs running approximately parallel to one another. Such an arrangement results in the security plug 22 being locked by both pins 23. This results in a greater retention force in comparison with a security plug which is locked only by one pin. Thus, as should be apparent upon comparing FIGS. 1 and 4, when the clasp 12 is closed, the leaf spring is depressed such that the locking element 26 engages the grooves of pins 23 to lock the pins to the housing (FIG. 1). When the leaf spring is released (FIG. 4), the locking element 26 does not engage the grooves of the pins and the pins can be removed from the housing of the security tag to release any article pinned thereby.

In contrast to the design which is shown purely as an example, the security plug 22 can advantageously also be pushed into the housing 11 from the other side, in order to avoid preventing the connection of the locking device 19 to an unlocking device, which is still to be described in the further text, when the security tag is suspended by means of the security plug 22 on an object which has a large surface, for example on an item of clothing.

The locking device 19 has a connecting piece 28 with a hole 29, on which connecting piece there can be placed the said unlocking device, with a reduced-pressure source. The reduced pressure is applied to the piston 20 so that it releases the clasp 12, which is pretensioned in the opening direction by the leafspring 18, for opening.

In contrast to the design shown, the connecting piece 28 of the locking device 19 can also be hemispherical.

FIG. 4 shows the security tag 10 with the clasp 12 opened. In this position, the gap or interruption 15 in the clasp is released out of the housing 11 so that an object which is to be protected can be attached thereto or removed therefrom. At the same time, the security plug 22 according to FIG. 7 is also released for removal.

From FIG. 5 it can be seen that the piston 20 presses onto the limb 14, under the pretensioning of the first spring 21, in order to latch into the locking or rest position when the clasp 12 is closed manually.

Means 30 are arranged in the housing 11 in order to trigger a signal when passing a detector which interacts therewith, but is not shown.

Figure 3:
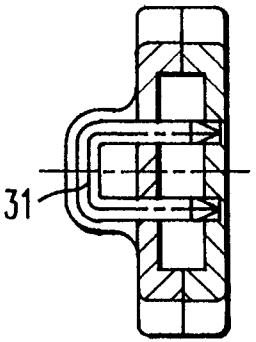
FIG. 3 shows a cross-section along the section line III—III in FIG. 1.

FIGS. 6 and 7 show two views of the security plug 22 from which it is apparent that its yoke 31 (FIG. 3), connecting the two pins 23, of the U-shaped part has a cap 32 which is fitted with a flange-like pressure rim 33, consisting of an elastomeric material, in order to compensate for different thicknesses of the object clamped therein (for example, to compensate for differing thicknesses of various garments which may be pinned to the tag with the pins 23).

FIGS. 8 and 9 show the security tag 10 in the closed and in the open position, with a cable 34, suspended on the clasp 12 and used as an extension, which has an eye 35 on each of its two ends. In consequence, larger objects can also be gripped and provided with the security tag 10. By means of different lengths of the cable, it can be achieved that the object has a loop or lashing around it, at least approximately without any play.

FIG. 10 shows an unlocking device in longitudinal section. Said device has a piston-cylinder arrangement 46, 47, as a reduced-pressure source, which can be operated by means of a lever arrangement 42, consisting of the lever arms 44, 45.

The piston 47, designed as a suction piston, is connected to a hollow piston rod 48 on whose opposite end 49 to the piston an adaptor 41 is arranged on which the security tag 10 (FIG. 1) is placed. Immediately in front of the piston 47, the piston rod 48 has an opening 50, which opens into the cylinder 46.

When the lever 44 is pressed down, the content of the space in the cylinder 46 increases so that a reduced pressure is generated therein. By means of the opening 50, the hollow piston rod 48 and the adaptor 41, the reduced pressure is transferred onto the security tag, which is placed thereon but is not shown in FIG. 10. The shape of the adaptor 41 is matched to that of the connecting piece 28 of the security tag.

In FIG. 10, the unlocking device 40 rests on a base 53 onto which it is plugged by way of means 52 arranged on its underside 51.

As should be readily apparent from the foregoing, the security tag advantageously provides two fastening or connecting arrangements: (1) the clasp; and (2) the plug or pin arrangement; which can be selectively utilized depending upon the article to which the tag is to be connected. Conveniently, both fasteners are locked upon locking of the same locking device 19.

We claim:

1. A security arrangement which includes a tag which can be connected to an object to signal a theft or attempted theft comprising:

a tag having a housing including a signalling device therein;

a first fastening part movable relative to said housing between a first part fastened position and a first part unfastened position;

a second fastening part movable relative to said housing between a second part fastened position and a second part unfastened position; and locking means for locking said first fastening part and said second fastening part in the respective first part fastened position and second part fastened position; and an unlocking device for unlocking said locking means to thereby allow said first fastening part and said second fastening part to be moved to the respective first part unfastened position and the second part unfastened position, and wherein said unlocking device includes means for generating a vacuum.

2. The security arrangement of claim 1, wherein said first fastening part is a clasp having a first portion which is connected to said housing in both said first part fastened position and said first part unfastened position, and wherein a second portion of said clasp is spaced from said housing in said first part unfastened position.

3. The security arrangement of claim 1, wherein said first fastening part is a clasp and said second fastening part includes a pin.

4. The security arrangement of claim 1, wherein said second fastening part is a pin which is connected to said housing in said second part fastened position and wherein said pin is separate from said housing in said second part unfastened position.

5. The security arrangement of claim 1, wherein said locking means includes a piston movable between locked and unlocked positions, said locking means further including a spring biasing said piston into said locked position.

6. The security arrangement of claim 5, wherein said locking means includes an opening therein for placing said locking means in communication with said unlocking device, wherein application of a vacuum pressure by said unlocking device causes said piston of said locking means to move to said unlocked position in opposition to said spring.

7. The security arrangement of claim 1, further including an elastomeric material disposed about at least a portion of said second fastening part.

8. The security arrangement of claim 1, further including a cable mounted upon said first fastening part.

9. The security arrangement of claim 8, wherein said cable includes first and second ends, each of said ends including an eyelet which receives said first fastening part.

10. The security arrangement of claim 1, wherein said locking means includes a protruding portion which protrudes from said housing, said protruding portion having an aperture therein, said unlocking device including a recess sized to receive said protruding portion.

11. The security arrangement of claim 10, wherein said locking means includes means for releasing said first fastening part and said second fastening part upon application of a vacuum by said unlocking device.

12. A security arrangement which includes a tag which can be connected to an object to signal a theft or attempted theft comprising:

a tag having a housing including a signalling device therein;

a first fastening part movable relative to said housing between a first part fastened position and a first part unfastened position;

a second fastening part movable relative to said housing between a second part fastened position and a second part unfastened position; and locking means for locking said first fastening part and said second fastening part in the respective first part fastened position and second part fastened position; and an unlocking device for unlocking said locking means to thereby allow said first fastening part and said second fastening part to be moved to the respective first part unfastened position and the second part unfastened position, wherein said unlocking device includes a lever coupled to a piston, said piston disposed within a cylinder, and wherein a piston rod is connected to said piston and includes an opening extending through said piston rod with said opening including first and second outlets, said first outlet disposed on one side of said piston such that upon movement of said piston by said lever a reduced pressure is generated on said one side of said piston by increasing a spacing between said piston and an end of said cylinder, said second outlet of said piston rod communicating with an outlet of said unlocking device, and further wherein said locking means includes piston means which release said locking means upon application of a vacuum by said unlocking device.

13. An unlocking device for unlocking a theft detecting assembly comprising:

an actuator;

a piston coupled to said actuator such that movement of said actuator causes movement of said piston;

a cylinder including a chamber, said piston disposed inside of said chamber; and a piston rod having a passage extending therethrough, and having first and second outlets in communication with said passage, and wherein a first of said outlets is disposed adjacent one side of said piston such that as said piston is moved by said actuator a pressure change is generated in said cylinder and said pressure change is transmitted through said piston rod by way of said passage.

14. The unlocking device of claim 13, wherein said unlocking device includes a recess for receiving a portion of a theft detecting assembly, said recess including a port in communication with said second outlet of said piston rod.

15. The unlocking device of claim 13, further including a base, and wherein said actuator is a lever movable toward and away from said base, and wherein said piston is disposed inside of said cylinder such that upon movement of said lever toward said base, a spacing between said one side of said piston and an end of said cylinder increases such that a reduced pressure is created between said piston and said end of said cylinder, and wherein said reduced pressure is transmitted through said piston rod.

16. A security arrangement comprising:

a security tag having a housing with a signalling device disposed therein;

a fastening part movable relative to said housing between a fastening position and a non-fastening position;

a locking device connected to said housing for locking said fastening part in said fastening position, said locking device including means for releasing said fastening part from said fastening position upon application of a reduced pressure; and an unlocking device including means for generating a reduced pressure.

17. A security assembly comprising:

a tag having a housing with a signalling device connected to said housing;

a C-shaped fastener part having first and second ends separated by an opening thereby providing said C-shape, said C-shaped fastener part movable relative to said housing between fastened and unfastened positions, wherein in said fastened position, said opening is disposed inside of said housing and in said unfastened position said opening is disposed outside of said housing;

a locking device including a movable member which is movable between a locking position and a release position, wherein when said C-shaped fastener part is in said fastened position and said movable member is in said locking position said movable member prevents movement of said C-shaped fastener part, and in said release position said movable member allows movement of said C-shaped part to said unfastened position;

wherein said movable member is a piston, said locking device further including a spring biasing said piston toward said locking position and wherein said piston of said locking device is at least partially disposed in a chamber such that upon application of a reduced pressure to said chamber, said piston is moved to said release position.

18. The security assembly of claim 17, wherein said piston of said locking device is disposed in a cylinder portion which forms an exterior protrusion on said housing.

19. The security assembly of claim 17, further including an unlocking device including means for generating a reduced pressure.

20. The security assembly of claim 17, further including a pin fastener member, said housing including an aperture for receiving said pin fastener member.

21. The security assembly of claim 20, further including an elastomeric material disposed about at least a portion of said pin fastener member.

22. The security assembly of claim 20, further including a pin engaging member disposed inside of said housing for holding said pin fastener member in said aperture of said housing.

23. The security assembly of claim 22, wherein said pin engaging member is located at a position in said housing such that when said C-shaped fastener part is in the fastened position said pin engaging member cannot move to release said pin fastener member such that said pin fastener member is locked to said housing.

24. The security assembly of claim 23, further including a leaf spring disposed between said C-shaped fastener part and said pin engaging member, and wherein said pin engaging member is mounted to said leaf spring.

25. The security assembly of claim 17, wherein in said locking position said movable member is disposed between said first and second ends.

26. A security assembly comprising:

a tag having a housing with a signalling device connected to said housing;

a C-shaped fastener part having first and second ends separated by an opening thereby providing said C-shape, said C-shaped fastener part movable relative to said housing between fastened and unfastened positions, wherein in said fastened position, said opening is disposed inside of said housing and in said unfastened position said opening is disposed outside of said housing;

a locking device including a movable member which is movable between a locking position and a release position, wherein when said C-shaped fastener part is in said fastened position and said movable member is in said locking position said movable member prevents movement of said C-shaped fastener part, and in said release position said movable member allows movement of said C-shaped part to said unfastened position;

the assembly further including a pin fastener member, said housing including an aperture for receiving said pin fastener member, a pin engaging member disposed inside of said housing for holding said pin fastener member in said aperture of said housing, and wherein said pin engaging member is located at a position in said housing such that when said C-shaped fastener part is in the fastened position said pin engaging member cannot move to release said pin fastener member such that said pin fastener member is locked to said housing, the assembly further including a leaf spring disposed between said C-shaped fastener part and said pin engaging member, and wherein said pin engaging member is mounted to said leaf spring;

wherein said pin fastener member includes grooves formed thereon which are engaged by said pin engaging member.

* * * * *